US005552772A

United States Patent [19]

Janky et al.

[11] Patent Number: 5,552,772

[45] Date of Patent: Sep. 3, 1996

[54] LOCATION OF EMERGENCY SERVICE WORKERS

[75] Inventors: James M. Janky, Los Altos; John F. Schipper, Palo Alto, both of Calif.

[73] Assignee: Trimble Navigation Limited, Sunnyvale, Calif.

[21] Appl. No.: 171,552

[22] Filed: Dec. 20, 1993

[51] Int. Cl.[6] ..... G08B 23/00

[52] U.S. Cl. ..... 340/573; 340/539; 340/825.36; 340/825.49; 455/56.1; 342/463

[58] Field of Search ..... 340/573, 539, 340/825.36, 825.49; 455/56.1, 67.1, 45, 53.1, 54.1, 54.2; 342/453, 454, 457, 450, 463, 451

[56] References Cited

U.S. PATENT DOCUMENTS

| | | | |
|---|---|---|---|
| 4,468,656 | 8/1984 | Clifford et al. | 340/539 |
| 4,633,231 | 12/1986 | Kilian | 340/539 |
| 4,706,689 | 11/1987 | Man | 340/539 |
| 4,791,572 | 12/1988 | Green, III et al. | 342/450 |
| 5,153,584 | 10/1992 | Engira | 340/825.49 |
| 5,157,378 | 10/1992 | Stumberg et al. | 340/539 |
| 5,173,710 | 12/1992 | Kelly et al. | 342/457 |
| 5,218,344 | 6/1993 | Ricketts | 340/539 |
| 5,293,318 | 3/1994 | Fukushima | 342/457 |

*Primary Examiner*—Glen Swann
*Assistant Examiner*—Benjamin C. Lee
*Attorney, Agent, or Firm*—John Schipper

[57] ABSTRACT

Method and apparatus for monitoring the present location of an emergency or general serviceperson, such as a firefighter or a hazardous materials spill clean-up specialist, assigned to perform emergency services at a designated site. The site diameter can be as small as a few meters or as large as several kilometers. The serviceperson's present location can be checked at selected time intervals with time periods ranging from a few hundred milliseconds to thousands of seconds, as desired. The serviceperson wears or carries a location-determining ("LD") unit that receives electromagnetic signals that contain information allowing determination of the present location of the LD unit, and thus of the serviceperson, from three or more signal sources. These signal sources may be FM subcarrier signal transmitters, or may be an integrated combination of FM subcarrier signal transmitters and (1) transmitters for a Loran, Omega, Decca, Tacan, JTIDS Relnav or PLRS or other ground-based system, or (2) transmitters for a satellite-based positioning system, such as GPS or GLONASS, or other broadcast sources. The relative phases or transmission times for the signals from each source are determined and provided for the LD unit. The present location of the serviceperson, or change thereof, is determined and transmitted to a central station at selected interrogation times, or upon occurrence of any of a specified group of other conditions. The central station transmits an alarm signal if one or more of the following conditions is present: (1) the worker's LD is not within the designated site; (2) the central station does not receive transmitted present location information from the LD unit for at least K consecutive interrogation times; or (3) the location of the LD unit changes by less than a selected threshold amount in a time interval of selected length $\Delta t_{change}$; or (4) a physiological indicium of the serviceperson is in a danger zone.

22 Claims, 7 Drawing Sheets

LOCATION OF EMERGENCY SERVICE WORKERS

FIELD OF THE INVENTION

This invention relates to use of electromagnetic signals to determine the present location of an emergency service worker, such as a firefighter or hazardous materials cleanup specialist, at the site of an emergency.

BACKGROUND OF THE INVENTION

After a firefighter has arrived at, and begun working at, a fire site, the present location of that firefighter may be difficult to determine, minute-by-minute. The firefighter may be working outside an enflamed structure but be hidden by the firefighting equipment or some other structure or by the local terrain. If the firefighter is working inside the structure, the problem of locating this person is doubly difficult, because line-of-sight location is usually impossible and because radio waves used for voice communication may not be transmitted past the structures walls. Visually perceptible markings have been developed for firefighters' out garments, and methods have been developed for locating the perimeter of a fire. However, methods for determining the present location of a firefighter or other emergency worker at the site of an emergency, second-by-second, no matter where the worker may be located, have not appeared yet.

Tung discloses a retroreflective protective helmet having a plurality of retroreflective stripes thereon that can be seen in darkened areas, if illuminated by light, in U.S. Pat. No. 3,885,246. The helmet requires line-of-sight visibility before the helmet can be illuminated and the retroreflected light can be visually perceived. Another protective and retroreflective helmet, with the same limitations on visual perception, is disclosed in U.S. Pat. No. 4,008,949, issued to Luna.

Bingham, in U.S. Pat. No. 4,533,592, discloses an upper body garment made of thermally stable, flame retardant material that includes a plurality of light-reflecting stripes thereon, for use in firefighters' coats. As in the Tung and Luna patents, use of this garment to locate a firefighter requires line-of-sight illumination of the stripes.

In U.S. Pat. No. 4,347,501, Akerberg discloses a portable alarm system useful for notifying others that the alarm sender requires assistance. The alarm signal carries a unique code that allows a central receiver to identify the sender. The alarm signal is relayed from the sender to the central station by intermediate retransmitters, positioned in or near the room where the alarm device wearer is located, that transmit the alarm signal with a code indicating the last known location of the wearer. The alarm device wearer would occasionally update the alarm system's knowledge of his/her location by moving to another room in the structure. This system requires that a one or more alarm signal retransmitters be located in each room of the structure and that the retransmitter perform its intended functions under all circumstances. Where a firefighter responds to a tire, these conditions will not often be present.

An out-of-range personnel monitor and alarm, useful for convalescent home residents and other monitored persons, is disclosed in U.S. Pat. Nos. 4,593,273 and 4,675,656, issued to Narcise. The monitored person carries a transceiver that receives a first signal and compares the first signal strength against a selected threshold that corresponds to a maximum distance the monitored person can move away from the first signal transmitter. If the first signal strength is below the selected threshold, the transceiver transmits a second signal that is received by a monitoring station, advising that the monitored person has moved outside the permitted range. This system requires that the region within which the monitored person moves is reasonable homogeneous in attenuating electromagnetic signals, and that the first signal generator can be located near the center of the permitted region of movement for the monitored person.

Engler et al disclose use of a high temperature resistant, retroreflective material for marking a firefighter's helmet, in U.S. Pat. No. 5,160,655. The helmet marking material reflects light directed at the helmet back toward the light source so that a firefighter's present location can be determined if (1) the firefighter is within a line of sight from the light source and is not concealed within a building and (2) the ambient gaseous medium at the fire site is not so smoke-filled that the light incident on, or reflected from, the helmet marking material is absorbed by the gas.

Treddenick, in U.S. Pat. No. 5,192,500, discloses a firefighter safety badge, having indicia on a first badge face regarding the medical history of the badge user, and having indicia on a second badge face noting the anticipated location of the badge user on the fire site. The second indicia can be removed to expose a plurality of indicator strips that are sensitive to different toxic gases, such as chlorinated hydrocarbons. The badge is intended to be secured to a post or other structure near where the badge user is working. However, if the present location of the badge user changes and the second badge face indicia is not changed to reflect this change, the badge user cannot be located using this indicia.

A personal alarm security apparatus that is worn on an arbitrary part of a person's body is disclosed by Young in U.S. Pat. No. 5,196,825. Normally, the apparatus transmits a first signal that is interpreted as indicating that no threatening event has occurred or is occurring. If an emergency or threatening event occurs, a second signals is transmitted. A redundant third signal is transmitted at the time the second signal should be transmitted, in case the second signal is not transmitted for whatever reason. The system uses two receivers to obtain some information on the wearer's present location when a second signal is received.

Several U.S. patents disclose sensing the approximate perimeter of a tire, using infrared or similar means to sense temperature level differences or other characteristics that distinguish enflamed from non-enflamed areas. These patents include U.S. Pat. No. 5,160,842, issued to Johnson, and a sequence of U.S. patents issued earlier to Brown de Colstoun et al (U.S. Pat. Nos. 4,567,367, 4,893,026 and 5,049,756). However, none of these approaches appears to allow determination of the present location of a firefighter or other emergency service worker within an enflamed region or other emergency site.

FM subcarrier signals and AM carder signals have been used for some types of radio wave communications. In U.S. Pat. No. 3,889,264, Fletcher discloses a vehicle location system in which the unsynchronized AM carrier signals from three or more AM radio stations form hyperbolic isophase grid lines that are used to determine location of a vehicle. The vehicle must be equipped with a three-channel, tunable receiver, and its location must be referenced to an initial known location by counting the number of isophase lines crossed after the vehicle leaves the initial location. Isophase drift is compensated for by subtraction from the count.

Dalabakis et al, in U.S. Pat. No. 4,054,880, disclose a radio navigation and vehicle location system employing three low frequency subcarrier signals received from three radio stations at a three-channel, tunable receiver located on the vehicle. Isophase lines crossed are counted after the vehicle leaves an initial known location. This system, like the Fletcher system, is a delta-position system that determines vehicle location only relative to an initially known location.

U.S. Pat. No. 4,646,290, issued to Hills, discloses use of F.C.C.-approved Subsidiary Communication Authorization (SCA) FM subcarrier signals for one way transmission. This patent discloses transmission of a plurality of messages, which may be delivered to the transmitter at a wide range of bit rates, to be transmitted at a single bit rate that is at least as large as the highest bit rate for message delivery. This method allows for downstream insertion of additional data.

An integrated radio location and communication system for a mobile station is disclosed by Martinez in U.S. Pat. No. 4,651,156. Each mobile station carries a transceiver that issues radio signals that are received by two or more signal transceiver reference sites having fixed, known locations. The transceivers at the mobile station and the reference stations are continuously phase locked to the RF carrier signal from a nearby commercial radio station. The radio station and the mobile station each transmit a brief, distinguishable range tone at a known sequence of times, and the range tone from each station is received by each reference station. From an analysis of the differences in arrival times of the range tones received from the radio station and from the mobile station, the reference stations determine the two-dimensional location of the mobile station. The mobile station uses the beat signal between two RF subcarrier frequencies to generate its range tone signal and to distinguish that mobile station transmissions from the transmissions of any other mobile station.

Young et al, in U.S. Pat. No. 4,660,193, discloses use of two SCA FM subcarrier signals, the first being amplitude modulated and the second being phase modulated, to provide a digital data transmission system. A subcarrier signal within this system may also be modulated to carry audio signals.

A multichannel FM subcarrier broadcast system that provides a sequence of relatively closely spaced channels, using independent sidebands of suppressed carriers, is disclosed by Karr et al in U.S. Pat. No. 4,782,531. The sideband signals are generated in pairs and are phase shifted before transmission. Upon receipt of the transmitted signals, the process is reversed. An earlier patent, U.S. Pat. No. 3,518,376, issued to Caymen and Walker, discloses a similar approach without use of signal phase shifting of pairs of sideband signals.

In U.S. Pat. No. 4,799,062, Sanderford et al disclose a radio location method that uses a central processing station, a plurality of signal repeater base stations with fixed, known locations, and a mobile station with a known location at any time. The central station transmits a master grid synchronization pulse, which serves as a time reference, to the other stations at a selected sequence of times. A roving station with unknown location transmits a pulse that is received by three or more base stations and is retransmitted to the central station. The central station determines the location of the roving station using the differences in time of arrival at each base station of the pulse transmitted by the roving station. The mobile station also transmits a pulse from time to time, and its known location is compared with its computed location by the central station to determine any multipath compensation required to reconcile the known and computed locations of the mobile station. The multipath compensation for a mobile station adjacent to the roving station is applied to correct the computed location of the roving station.

Ma, in U.S. Pat. No. 4,816,769, discloses receipt of SCA FM subcarrier signals for digital data paging at a radio receiver. The system measures signal-to-noise ratio of an output amplitude of a Costas loop, used to phase lock to the FM subcarrier frequency, to determine if the signal is sufficiently strong to be processed.

A system for detection of radio wave propagation time, disclosed by Ichiyoshi in U.S. Pat. No. 4,914,735, uses detection of phase differences for transmission of the signal over M ($\geq 2$) different known signal paths to a target receiver. The transmitted signal includes a subcarrier signal, having a frequency that is higher than the transmitter clock frequency, modulated with a known modulation signal. The receiver has M demodulators for the signals received by the M different paths and has a phase comparator to compare the computed phases for each of these received signals. The phase differences are proportional to the signal path length differences, if compensation for transmission line distortions is included.

U.S. Pat. No. 5,023,934, issued to Wheeless, discloses a system for communication of graphic data using radio subcarrier frequencies. The data are broadcast on a subcarrier channel and received by a radio receiver that is connected to a computer. The computer receives the subcarrier signals, displays the graphic data on a computer screen, and performs other functions, such as transmission error checking and modification of the displayed graphic data. The system is intended for weather data communication and display.

Westfall, in U.S. Pat. No. 5,073,784, discloses a system for location of a transmitter ("unknown") at large distances, using a large network of pairs of spaced apart radio wave receivers whose locations are known and whose relative phases are synchronized. A signal, broadcast by the unknown transmitter at less than HF frequencies, is received at different time and space points by pairs of receivers. Simple geometrical computations allow determination of the location of the unknown transmitter by comparing times of arrival of the transmitted signal.

U.S. Pat. No. 5,170,487, issued to Peek, discloses use of FM sub-carrier signals for a pager system for mobile users. A plurality of transmitters are used, each of which transmits an FM subcarrier signal or a carrier signal modulated with a chosen message signal, slightly offset in time. Each page-receiving unit is assigned a time slot, during which the receiving unit dials through the set of frequencies corresponding to the FM subcarrier and modulated-carrier signals to determine if a page message has been sent for that mobile user.

A system that allows determination of an absolute location of a vehicle is disclosed by Kelley et al in U.S. Pat. No. 5,173,710. FM subcarrier signals are received from three radio stations with known locations but unknown relative phases by signal processors at the vehicle and at a fixed station with known location relative to the three radio stations. The fixed station processor determines the relative phases of the three radio stations FM subcarrier signals and broadcasts this relative phase information to the vehicle. The vehicle processor receives this relative phase data and determines its absolute location, using the phases of the FM signals it senses at its own location.

Chon, in U.S. Pat. No. 5,193,213, discloses an FM broadcast band system for receipt of relatively high frequency FM subcarrier signals. A tunable high pass receiver first circuit receives the carrier and a tunable low pass second circuit receives the subcarrier signal. Each signal can then be separately processed.

A navigation and tracking system using differential LORAN-C or differential Decca signalling is disclosed by Duffett-Smith in U.S. Pat. No. 5,045,861. A reference station transmits a reference signal to a mobile station and to three or more local LORAN-C or Decca (fixed) stations having known locations relative to the reference station. The fixed stations retransmit the reference signal to the mobile station, where the phase received signal differences are compared to determine the location of the mobile station.

Most of these systems use a single communication system, rather than integrating two or more communication systems to provide location or navigation information for a mobile user. What is needed is an integrated location determination system for automatically or discretionarily determining the present location of a firefighter or other emergency service worker second-by-second at an emergency site, whether the worker presently works outside or inside a structure. Preferably, the system should accumulate and report on he time the worker spends in one or more selected sub-regions at the site. Preferably, the system should be at least partly portable, should work indoors or outdoors, and should provide estimates of location with inaccuracies no greater than ten meters, and more preferably no greater than one meter. Preferably, the system should allow a choice between location information provided by two or more location determination systems, based on a comparison of one or more parameters that measure signal robustness and/or signal quality or station location for the signals received and analyzed by each communication system.

SUMMARY OF THE INVENTION

These needs are met by the invention, which provides a location determination system that can be used inside buildings and other structures as well as outside such structures to provide an accurate determination of the present location of any firefighter at a fire site, or of an emergency service worker at a service site. The system does not require line-of-sight contact with the firefighter. In a first embodiment, each firefighter carries a location determination ("LD") unit that receives electromagnetic signals from a single group of LD signal sources, here a group of spaced apart FM subcarrier signal sources. A central station located at or near the fire site interrogates tone or more selected LD units, and each selected LD unit automatically responds by transmitting its unprocessed, partly processed or fully processed LD information to the central station for further processing, storage and/or display.

In another embodiment, the central station assigns each LD unit at the site, or a selected subset of such LD units, a sequence of mutually exclusive time slots, preferably in pairs, and interrogates each LD unit in turn. In the first of a pair of time slots, the central station transmits an Interrogation signal identifying one or more specified LD units. The specified LD unit(s) automatically responds in the second of the pair of time slots by transmitting unprocessed, partly processed-or fully processed information on its present location to the central station.

In another embodiment, the central station again interrogates one or more selected LD units and receives an automatic response from each selected LD unit. Each LD unit receives electromagnetic signals from a first group of LD signal sources, such as the FM subcarrier signal sources, and from a second, different group of LD signal sources, such as GPS signal sources or Loran signal sources. The interrogated LD unit determines or estimates its own present location and, based upon this location or on a measure of signal robustness or signal quality, selects the first group or the second group of LD information signals to transmit to the central station for further processing, storage and/or display. In another embodiment, the time slotted interrogation by the central station and the selection of one of two sources of LD information, based upon the present location of the LD unit, are combined.

The system can accumulate and report on the accumulated time a firefighter or other emergency worker is present in one or more designated, dangerous sub-regions at the site and can advise the Worker or a control person that this worker should leave a sub-region when this accumulated time exceeds a selected threshold.

DETAILED DESCRIPTION OF THE BEST MODE

Figure 1:
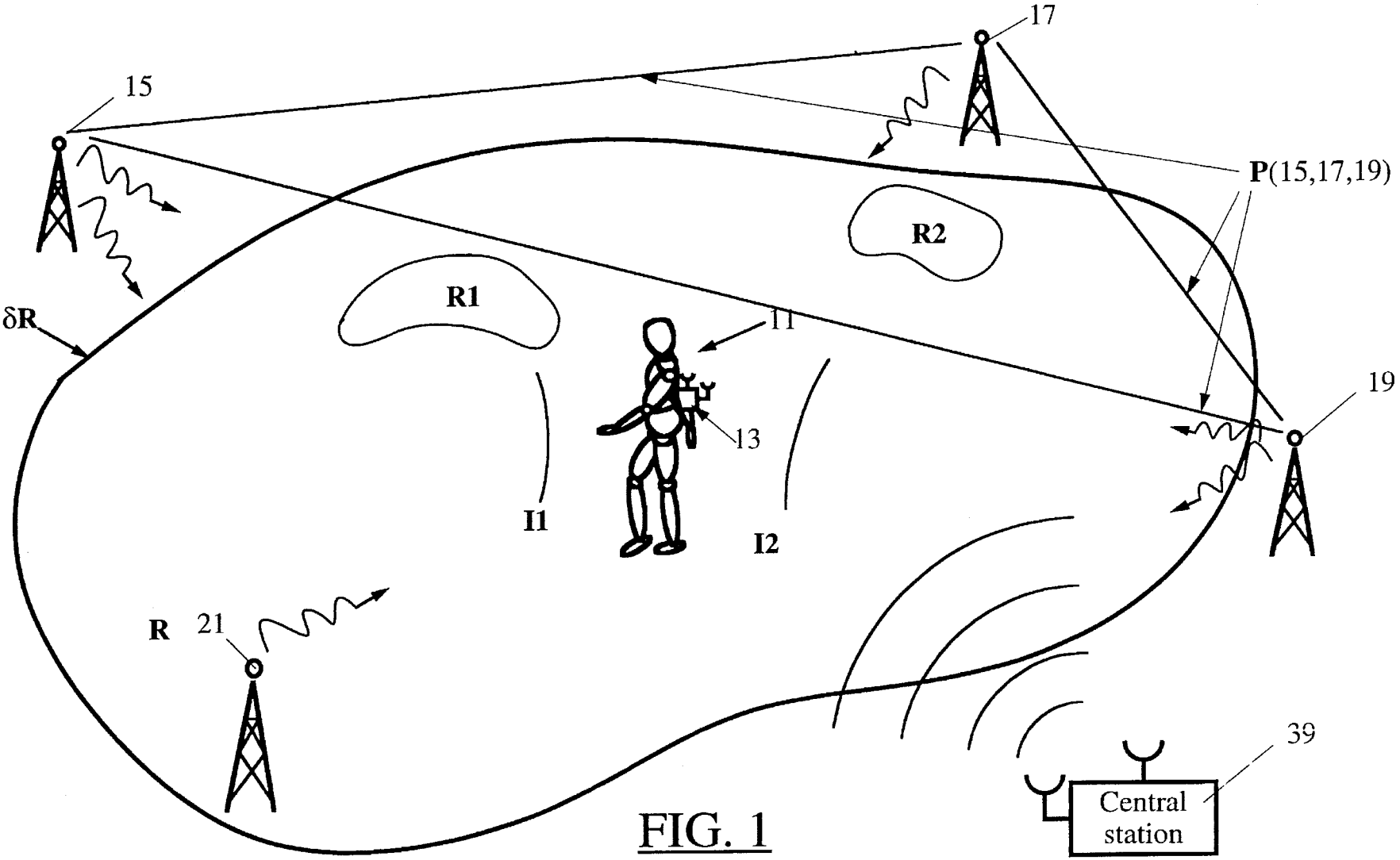
FIG. 1 is a schematic view of operation of one embodiment of the invention in a designated region or site R.

FIG. 1 illustrates practice of one embodiment of the invention. A serviceperson 11, such as a firefighter or hazardous materials cleanup specialist, works at a designated site or region R having a boundary δR. The serviceperson 11 wears a portable location determination (LD) unit 13. The LD unit 13 receives FM signals from three or more FM signal sources 15, 17, 19, 21 that have locations with known location coordinates ($x_m$, $y_m$, $z_m$) for FM signal source no. m (m=15, 17, 19, 21). The FM subcarrier signal of interest may have an associated frequency of about $f_c \pm 19$ kHz, where $f_c$ is the FM carrier frequency that lies in the range 88–108 MHz. Alternatively, a higher order displacement from the carrier frequency (e.g., $f_c \pm 38$ kHz or $f_c \pm 57$ kHz) may be used. The sources of these FM subcarrier signals may be a plurality of FM broadcasting stations located in or near the site R. In this event, the subcarrier signals are obtained by filtering the total FM signals (carrier signal plus message signal plus subcarrier signal) to remove all but a subcarrier signal of a chosen frequency..

Figure 2:
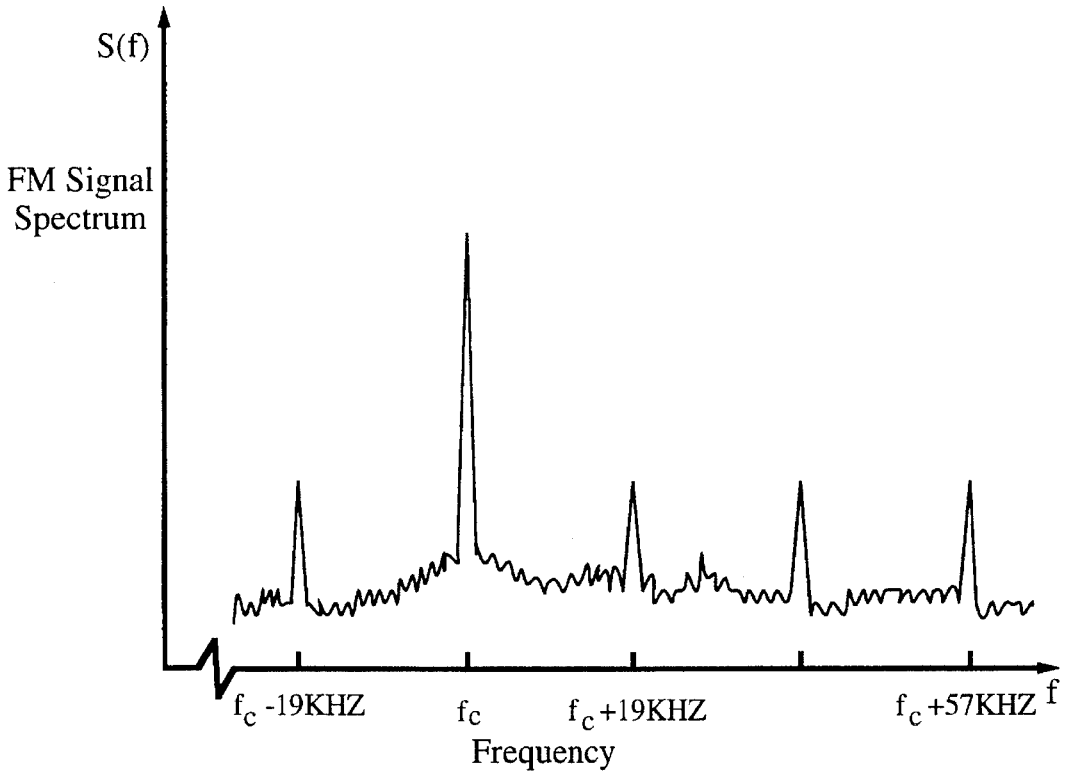
FIG. 2 is a graph illustrating a typical FM signal spectrum near the carrier frequency $f_c$ used for that signal.

FIG. 2 illustrates the full FM signal spectrum and the useful portion of the signal that remains (e.g., $f_c \pm 19$ kHz) after frequency filtering. FM subcarrier signals can be used for all monitoring of the present location of the serviceperson 11, inside and outside buildings and other structures. This , approach has the advantage of simplicity: only one set of radiowaves is used for location determination. FM signals are less subject to noise and other interference than are other signals, such as AM signals. Alternatively, an FM subcarrier signal can be replaced by an AM subcarrier signal, which is obtained by filtering an AM signal at a frequency displaced from the AM carder frequency by a relatively small amount. More generally, determination of the present location of the serviceperson 11 can be made using a location determination (LD) unit that receives and analyzes LD radiowave signals transmitted from one or more LD signal sources.

Figure 3:
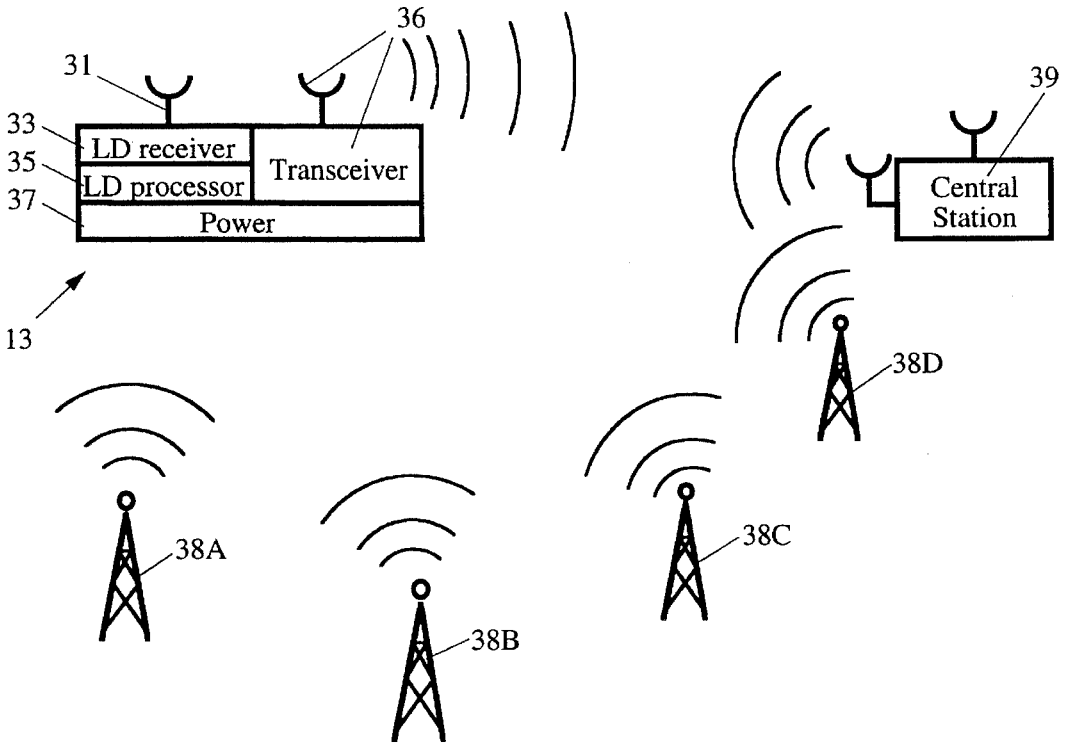
FIG. 3 is a schematic view illustrating use of a location determination unit that transmits and processes FM subcarrier signals, to determine the present location of a designated serviceperson according to the invention.

An LD unit 13, shown in FIG. 3, that is carried by or attached to the serviceperson 11 includes an LD antenna 31, an LD signal receiver 33, an LD signal processor 35, a signal transceiver 36 connected to the processor, and power supply 37, for receiving certain LD radiowave signals from one or more LD signal source 38A, 38B, 38C and/or 38D. Information from these LD signals may be transmitted, unprocessed, by the transceiver 36 to a central processing station 39, located at or near the site R, to allow determination of the present location of the serviceperson 11 periodically (e.g., second-by-second, or more or less often, if desired). In a first mode of operation of the LD unit 13, the LD signals received by the antenna 31 are passed to and transmitted by the transceiver 36, all signal processing occurs at the central station, and the LD signal processor 35 maybe deleted. Alternatively, the LD signals received by the LD unit 31 may be partly or fully processed by the LD signal processor 35 to partly or fully determine the present location of the LD unit. This processed information may be transmitted to the central station 39 for final determination of the present location of the serviceperson 11.

If the serviceperson 11 is outdoors or is within any building or other structure that is not electromagnetically isolated, the LD signals may have any frequency, and GPS, GLONASS, Loran, Omega, Decca, Tacan, JTIDS Relnav, PLRS, FM subcarrier signals, AM subcarrier signals or other radiowave signals may be used. If the serviceperson 11 is within an electromagnetically isolating structure, FM subcarrier signals may often still be received within the structure without disabling signal" attenuation or signal distortion.

In the embodiment illustrated in FIG. 1, the invention uses FM subcarrier signals emitted by three or more spaced apart FM signal sources 15, 17 and 19, positioned at known locations in the community, together with an FM signal monitor (and, optionally, source) 21 that is also located at a known position. If the FM signal monitor 21 also serves as a source, this source is preferably separated by a large distance from a plane P(15,17,19) passing through the locations of the other three FM station antennas. In this instance, the source 21 may be located on a very tall tower, for example, relative to the heights of the transmitting antennas of the other FM sources 15, 17 and 19.

The FM signal monitor 21: (1) receives the FM subcarrier signals transmitted by the other FM stations 15, 17 and 19; (2) determines the relative phases of these subcarrier signals at their respective sources, using the known distances of the antennas of each of the other FM stations 15, 17 and 19 from the FM monitor 21; (3) transmits a signal on another selected frequency that advises any FM subcarrier signal receiver of these relative phases; and (4) optionally transmits its own FM subcarrier signal, with a phase determined by an optional selected linear combination of the phases of the other three FM subcarrier signals, or determined independently of the other three phases. The serviceperson 11 wears the portable LD unit 13 and is assigned an identifying indicium that is included in any transmission by that LD unit to the central station 39. Optionally, the central station 39 can continually or periodically advise a communications, command and control (C3) center of the location of the serviceperson 11, or of the locations of several such persons.

The LD unit 13 serves as a mobile station that receives the FM subcarrier signals and optionally transmits phase information for each of these subcarrier signals to the central station 39 for (further) processing and analysis. The central station 39 has a known location relative to each of the FM signal sources 15, 17, 19 and FM signal monitor 21 and can determine the phase of each these FM signals relative to a selected phase reference or can determine the FM signal source phases relative to each other at a selected time. One advantage of use of relatively low frequency FM signals, such as $f_c \pm 19$ kHz, is that such signals are attenuated and/or distorted less, in passing through walls, floors and ceilings of normal buildings, than are higher frequency radiowave signals, such as AM signals. In normal circumstances, the relative phases of the FM signal sources 15, 17, 19 and FM monitor 21 would not change, or would change at most a few times in any 24-hour period. However, the invention provides for the possibility that these relative phases can change often and/or quickly.

At or around a given time t=t0, the FM subcarrier signals broadcast by the FM sources 15, 17, 19 and FM monitor 21 (optional) are $$S_m(t)=S_0 exp[j((\omega_m t-\phi_m)](m=15,\ 17,\ 19,\ 21)\ (j^2=-1), \quad (1)$$

where $\omega_m$ and $\phi_m$ are the subcarrier frequency and present phase of the FM signal source number m. The subcarrier frequencies $\omega_m$ are preferably distinct from and spaced apart from one another. Optionally, the signal $S_m(t)$ may itself be modulated with a known signal to produce a signal $S_{m,mod}(t)$ that is different for each source (m) and that allows identification of each source signal, independently of whether the subcarrier frequencies are distinct. The subcarrier signals are received at the LD device 13 as time-varying signals of the form $$S'_m(t)=S_0 exp[j(\omega_m t-\phi_m-\phi_m d_m/c')]\ (m=15,\ 17,\ 19,\ 21), \quad (2)$$

where c' is the average propagation velocity in the transmission medium (mostly air) and $$d_m=[(x-x_m)^2+(y-y_m)^2+(z-z_m)^2]^{1/2} \quad (3)$$

is the distance from the FM signal source number m to the LD unit 13, whose present location coordinates (x, y, z) are as yet undetermined.

If the phases $\phi_m$ are known, the distances $d_m$ can be determined from Eq. (2). From any three physically realistic three distances, such as $d_{15}$, $d_{17}$ and $d_{19}$, two candidate location coordinate triples (x,y,z) can be found that, in principle, satisfy Eqs. (3) for measured distances $d_m$ (or phases $\phi_m$). Adding , the distance $d_m$ of a fourth FM subcarrier signal source, such as 21, will, in principle, allow elimination of one of these two candidate triples so that only one location coordinate .triple (x, y, z) remains, for the present location of the LD unit 13. In practice, this scheme will-not work well if the four FM signal sources lie approximately in a plane or in a line and the present location of the LD device 13 also lies close to or in that plane or that line. Preferably, one of the four FM signal sources, optional FM source 21, should be spaced far apart from the plane P(15, 17, 19) passing through the locations of any three other FM signal sources 15, 17 and 19. This formalism can be used for FM carrier or subcarrier signals or for AM carrier or subcarrier signals. This formalism can also be used for electromagnetic signals of any frequency emitted by a ground-based distance measuring system, such as Loran, Omega, Decca, Tacan, JTIDS Relnav or PLRS, or a Satellite Positioning System (SATPS), such as GPS or GLONASS, collectively referred to herein as an "outdoor LD system."

In one cycle of an FM subcarrier signal of frequency $f_m = f_{c,m} \pm$ 19 kHz (m= 15, 17, 19, and optionally 21), an electromagnetic wave will move a distance equal to one wavelength $\lambda = c'/\omega_m$, or about 15.8 kilometers (kin) in a vacuum. Thus, the distance of the LD device 13 from each FM signal source is known modulo 15.8 km. This distance ambiguity can be removed by initialization techniques. For example, if the designated site R has a diameter that is << 15.8 km, the present location of the serviceperson 11 can be determined at one location on the site R, with one set of FM signal source phases, and can be used for all locations on or adjacent to the site R by determining phase changes for each signal relative to this initial location. That is, the phase $\phi_m$ is initially determined at a time t= t0 for each FM or other location signal transmitter, using Eq. (2) or another suitable relation to determine the absolute or relative phases of the signals arriving from the signal source m at a known location, to determine the initial location of the serviceperson 11 on the site R.

Assume that FM signal source number m (m= 15, 17, 19, and optionally 21) has known coordinates $(x_m, y_m, z_m)$. From the determinable phase differences of the signals arriving from each FM source at a selected location with as-yet-undetermined coordinates (x,y,z) (such as the present location of the serviceperson 11), source number m is determined to lie at a distance $d_m$ from the selected location. FM subcarrier signals, emitted from FM sources 15, 17, 19 and 21 (optional) with synchronized phases, would arrive at the selected location with time differences $\Delta t_{ij}$ or source-to-source phase difference $\Delta\phi_{ij}$ (i≠j; i, j= 15, 17, 19, 21) that are determined by $$\Delta\phi_{ij}=2\pi(d_i-d_j)f/c'=f\Delta t_{ij}/c', \quad (4)$$

$$d_i=[(x-x_i)^2+(y-y_i)^2+(z-z_i)^2]^{1/2}, \quad (5)$$

where c' is the velocity of light propagation in the ambient medium and f is the frequency of the FM subcarrier signals. The three phase differences $\Delta\phi_{ij}$(i≠j; i,j= 15, 17, 19) define three intersecting hyperboloids or similar quadratic surfaces, each having two sheets. In general, the common intersections of each of these three groups of sheets should define a point or segment of a curve, where the two points (or curve segments) I1 and I2 shown in FIG. 1 are mirror images of each other with respect to the plane P(15,17,19) defined by the coordinates $(x_i,y_i,z_i)$ of the ith transmitter of the FM subcarrier signals. A fourth FM subcarrier signal source 21 (optional), because it is displaced from and does not lie on the plane P(15,17,19), transmits FM subcarrier/signals that have two distinct phase differences at the intersection points I1 and I2. This fourth FM subcarrier signal can thus distinguish between I1 and I2 and allow determination of the correct coordinates (x,y,z) for the selected location. This assumes that the phases of the four FM subcarrier signals are synchronized, with zero phase differences or known phase differences between any two of these signals. In practice, each of the four FM subcarrier signal sources will have a phase that may drift with time or change abruptly at particular times.

Where the four FM subcarrier signals have different phases, these source phase differences $\Delta\Phi_{ij}$ must be determined and removed before Eq. (4) can be used to determine the location coordinates (x,y,z) of the selected location, The phase differences $\Delta\Phi_{ij}$ can be determined by providing an FM subcarrier signal monitor station 21 that receives the other three FM subcarrier signals (i= 15, 17, 19 in this example) and determines the phase differences $\Delta\Phi_{i,21}$. The FM monitor 21 uses its knowledge of the separation distances between itself and the (other) FM subcarrier signal sources and of the measured signal phase differences at the monitor from the other three FM subcarrier signals. As noted above, the phase differences $\Delta\Phi_{i,21}$ may vary with time, through drift, abrupt change, or both. The FM signal monitor station 21 then broadcasts the phase differences $\Delta\Phi_{i,21}$ of the other sources (i=15, 17, 19), preferably with a carrier frequency that differs from the FM subcarrier frequencies of these other sources. These phase differences are received and stored and/or processed by a receiver at the LD unit 13. This LD unit 13 also receives the FM subcarrier signals and determines the "raw" or uncompensated phase differences $\Delta\phi_{ij}$ at its location (i, j= 15, 17, 19). A signal processor associated with the FM subcarrier receiver then forms the "true" or compensated phase differences $$\Delta\phi_{15,21}=2\pi(d_{15}-d_{21})/c'\Delta t-\Delta\Phi_{15,21}, \quad (6)$$

$$\Delta\phi_{17,21}=2\pi(d_{17}-d_{21})/c'\Delta t-\Delta\Phi_{17,21}, \quad (7)$$

$$\Delta\phi_{19,21}=2\pi(d_{19}-d_{21})/c'\Delta t-\Delta\Phi_{19,21}. \quad (8)$$

This compensates for non-synchronization and possible drifting of the FM subcarrier signals transmitted by the four FM subcarrier signal;sources. However, compensation is provided with respect to one of the four FM subcarrier signals, whose own phase may change with time.

Use of an FM signal monitor, which does not otherwise participate in determination of the selected location coordinates (x,y,z), to determine the phase differences $\Delta\phi_{ij}$ (i,j= 15,17,19) is disclosed in U.S. Pat. No. 5,173,710 issued to Kelley et al, which is incorporated herein by reference. The FM source phase differences $\Delta\phi_{ij}$ can be measured using a digital phase-locked$_7$ loop at the additional FM receiver/transmitter, as disclosed in FIGS. 4–11 and the accompanying text in the Kelley et al patent. In the subject invention, the FM signal monitor 21 used for monitoring the source-to-source phase differences optionally provides a fourth FM subcarrier signal (j=21), and the phase differences of the other three FM subcarrier signals are determined relative to the phase of the FM subcarrier signal transmitted by the FM signal monitor 21.

The FM signal monitor 21 can also serve as a reference station with accurately known location for differential position computations for determining the present location of the outdoor LD signal antenna. Differential position techniques use the known location of the reference station to remove some of the errors contained in signals received by a mobile station, such as the user 11, that is located within a few tens of kilometers from the reference station. Differential GPS techniques are discussed in Tom Logsdon, *The NAVSTAR Global Positioning System,* Van Nostrand Reinhold, 1992, pp. 76–90, and differential Loran techniques are discussed in U.S. Pat. No. 5,045,861, issued to Duffet-Smith, both of which are incorporated by reference herein. Thus, the FM signal monitor station 21 can include an outdoor LD signal antenna and associated outdoor LD signal receiver/processor, to receive the outdoor LD signals and to determine any location error values contained in these signals by comparison of the calculated location with the known location of the reference station. The FM signal monitor 21 can also include a transmitter to transmit these error values to a receiver/processor at the outdoor LD signal unit so that the calculated present location of the outdoor LD signal antenna can be adjusted by removal of outdoor LD signal errors that have been determined from the signals received at the FM signal monitor station 21 (which also serves as an outdoor LD signal reference station). Compensation for outdoor LD signal errors can be provided at the reference station 21 or at the outdoor LD unit.

Figure 4:
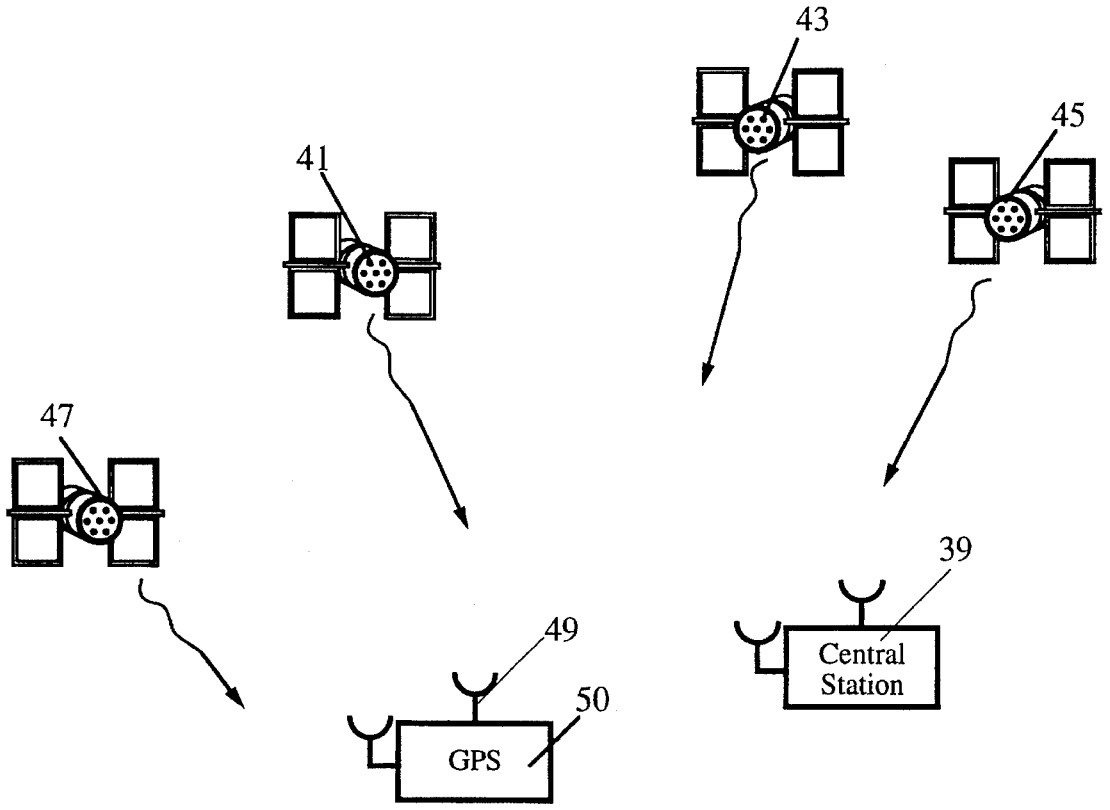
FIGS. 4 and 5 are schematic views illustrating use of outdoor location determination systems, using satellite-based signals and using ground-based signals, respectively, to determine the present location of a location determination unit according to the invention.

The location coordinates (x,y,z) of the LD unit 13 carded by the serviceperson 11, relative to an electronically sensible map of a selected portion of the Earth's surface that includes the coordinates of the designated site, are now known. The FM signals indicated in FIGS. 1 or 3 may be used outside as well as inside a building or other structure to allow determination of the present location of the serviceperson 11. Alternatively, FM signals may be used for inside-the-building location reporting and may be supplemented for outside-the-building location reporting by supplemental signal sources. One suitable outdoor LD signal source, illustrated in FIG. 4, is a Global Positioning System (GPS) or Global Orbiting Navigation Satellite System (GLONASS) or similar satellite-based location determination system (collectively referred to as GPS herein). A GPS includes a plurality of three or more visible, Earth-orbiting, non-geosynchronous satellites 41, 43, 45, 47 that each transmit a continuous, distinguishable electromagnetic signal that is received by a GPS antenna 49 and associated GPS signal receiver/processor 50 on or near the Earth's surface. The GPS receiver/processor 50 determines the present location of the GPS antenna by suitable processing of three or more GPS signals received from the GPS satellites 41, 43, 45, 47. A GPS and a GLONASS are discussed in more detail below. Global Positioning System signals are available throughout the world, whereas FM signal reception is often limited to line-of-sight reception, with a representative maximum reception distance of about 50 kilometers. A Global Positioning System is discussed in detail in Tom Logsdon, *The NAVSTAR Global Positioning System,* Van Nostrand Reinhold, 1992, pp. 17–90, which is incorporated by reference herein.

Because the GPS signals use a high frequency carrier (above 1 GHz), these signals may be severely attenuated and/or distorted if such signals fire received inside a building or other structure that is partly or fully electromagnetically insulating. For this reason, a GPS may be unsuitable for determination of the present location of a GPS antenna that is positioned within such a building or similar structure. However, the combined use of FM signals for location determination inside a building or similar structure (e.g., a deep shaft mine or tunnel under Or through the Earth) plus GPS signals for location determination outside a building or similar structure can provide a satisfactory LD system in most urban and non-urban communities.

Figure 5:
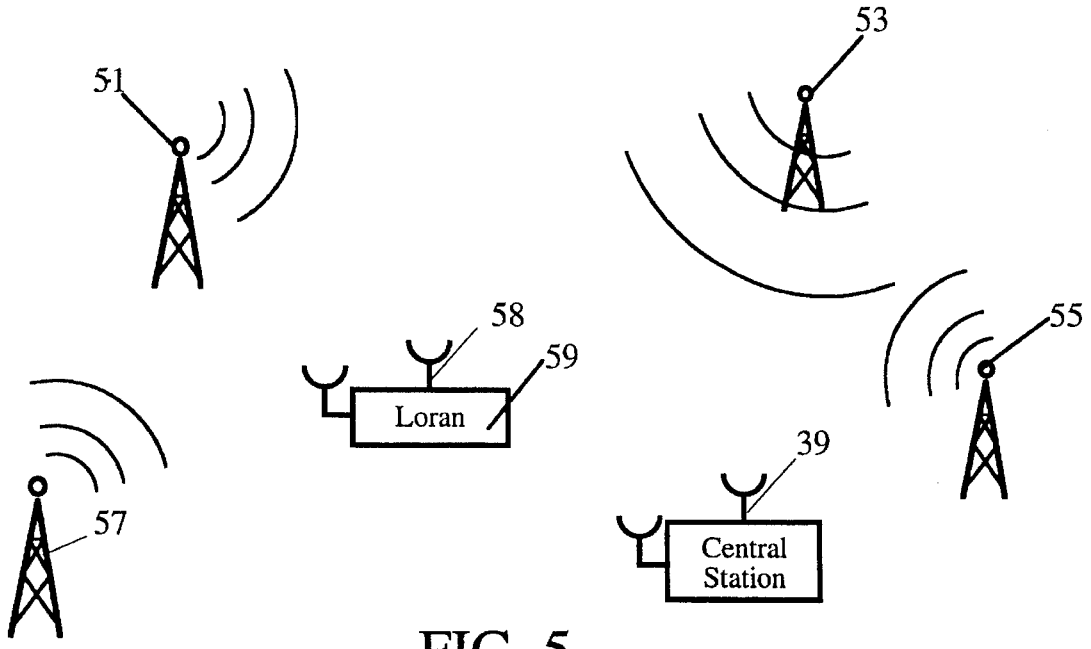

Alternatively, the GPS signals may be replaced by Loran-C signals produced by three or more Loran signal sources positioned at fixed, known locations, for outside-the-building location determination,, as illustrated in FIG. 5. A Loran-C system relies upon a plurality .of ground-based signal towers 51, 53, 55, and 57 preferably spaced apart 100–300 km, that transmit distinguishable electromagnetic signals that are received and processed by a Loran signal antenna 58 and Loran signal receiver/processor 59. A representative Loran-C system is discussed in *Loran-C User Handbook,* Department of Transportation, U.S. Coast Guard, Commandant Instruction M16562.3, May 1990, which is incorporated by reference herein. Loran-C signals use carrier frequencies of the order of 100 kHz and have maximum reception distances of the order of hundreds of kilometers. The combined use of FM signals for location determination inside a building or similar structure plus Loran-C signals for location determination outside a building or similar structure can also provide a satisfactory LD system in most urban and suburban communities.

Other ground-based radiowave signal systems that are suitable for use as part of an LD system include Omega, Decca, Tacan, JTIDS-Relnav (U.S. Air Force Joint Tactical Information Distribution System) and PLRS (U.S. Army Position Location and Reporting System) and are summarized in Logsdon, op. cit., pp. 6–7 and 35–40, incorporated by reference herein.

Other radiowave signals, such as emergency band signals in the frequency ranges 12.23–13.2 MHz, with suitable signal timing and a signal indicium included therein, can be used as a source of LD signals for outdoors locations. For convenient reference, a satellite-based or ground-based location determination system, not including a system that uses FM subcarrier signals or AM subcarrier signals, that can be used to determine the location of a serviceperson 11 over relatively long distances outside a building or other structure over the region R will sometimes be referred to as an "outdoor LD system".

Figure 6:
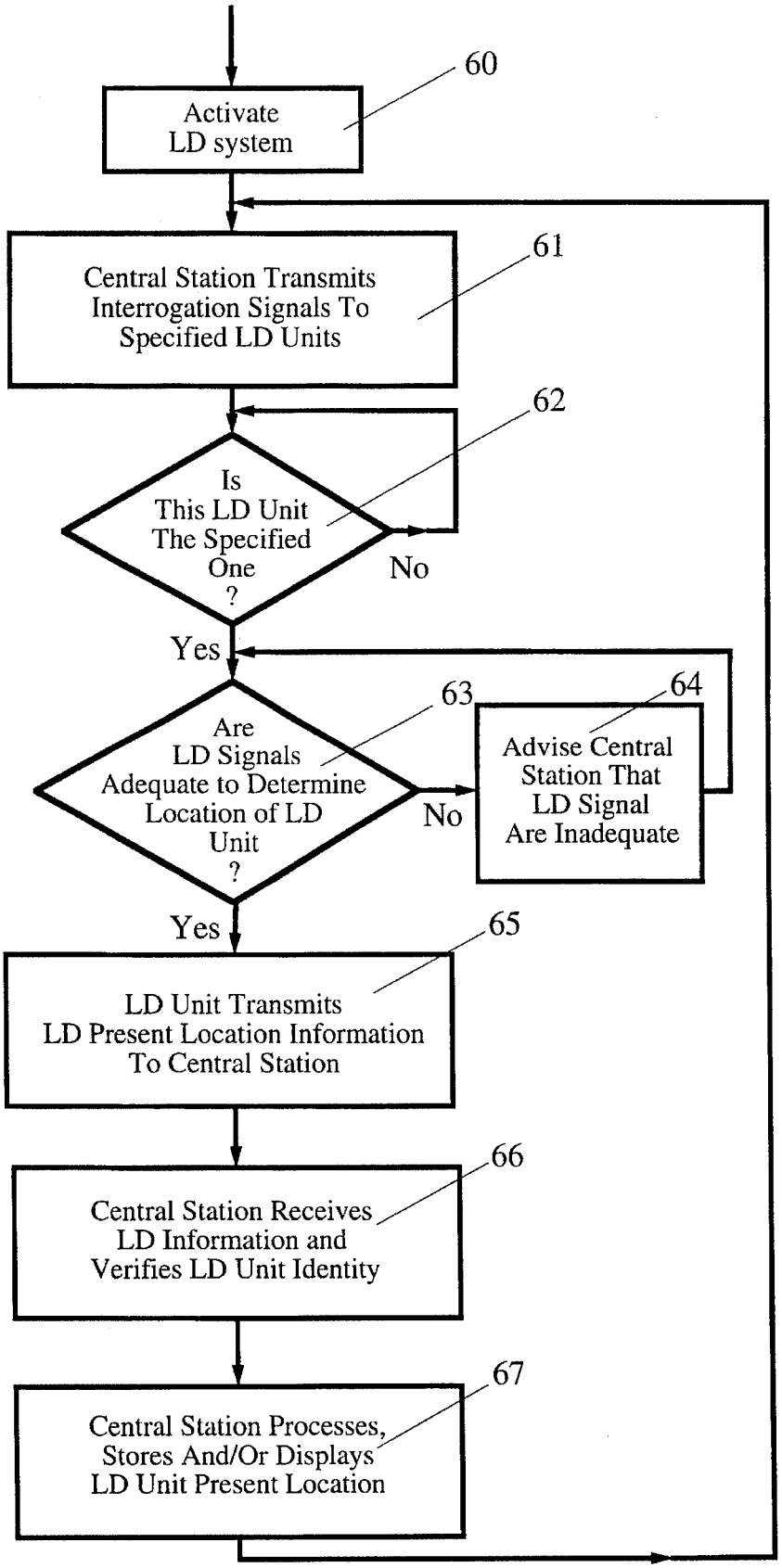
FIG. 6 is a flow chart illustrating a suitable procedure, according to the invention, for determining the present location of a location determination unit, using only FM subcarrier signals.

FIG. 6 is a flow chart of a procedure that can be used to determine the present location of the serviceperson 11, if an FM subcarrier system is used for all location determinations inside and outside buildings and other structures in a region R. In step 60, the LD system is activated and made ready to determine the present location of an identified or designated serviceperson 11. A central station or other interrogator transmits an interrogation signal (e.g., "Where are you?") in step 61, with an identifying label, tag or indicium attached that specifies the identified serviceperson 11, or specifies the LD unit 13 carded by that person. In step 62, each LD unit determines if it is the LD unit specified by the central station's interrogation signal. If a given LD unit is not the specified unit, that LD unit ignores this interrogation signal and recycles until receipt of the next interrogation signal. If the LD unit carried by the identified serviceperson 11 is the specified unit, this unit optionally determines if the FM subcarrier signals received are adequate to determine the present location of the LD unit, in step 63. If the FM subcarrier signals are inadequate, the LD unit optionally advises the central station of this circumstance, in step 64.

Assuming that the FM subcarrier signals are adequate to determine the present location of the LD unit or that step 64 is absent in the flow chart of FIG. 6, the LD unit responds, in step 65, by transmitting to the central station the last location fix computed by that LD unit and any other relevant and available information on the identified serviceperson's condition or circumstance. Preferably, the specified LD unit responds by transmitting the requested information to the central station in a time slot (of length 10–200 msec) allocated for this response. Preferably, the responding LD unit also includes a label, tag or other indicium identifying the responding LD unit. The central station receives the response signal from the LD unit and verifies that this signal carries the correct LD unit indicium, in step 66. In step 67, the central station processes, stores and/or visually or audibly displays information on the specified LD unit present location.

This procedure would be followed irrespective of whether the LD unit 13 is presently inside or outside a building or other structure, because only one LD system (FM subcarrier system) is providing the LD information. Alternatively, the LD unit can partly process the FM subcarrier signals and can transmit this partly processed information to the central station 39 for further signal processing and determination of the LD unit's present location. As a second alternative, the LD unit can automatically retransmit, unprocessed, suitable information (timing, relative phases, etc.) that the LD unit is receiving from each of the FM subcarrier signal sources and allow the central station to do all LD signal processing.

Figure 7:
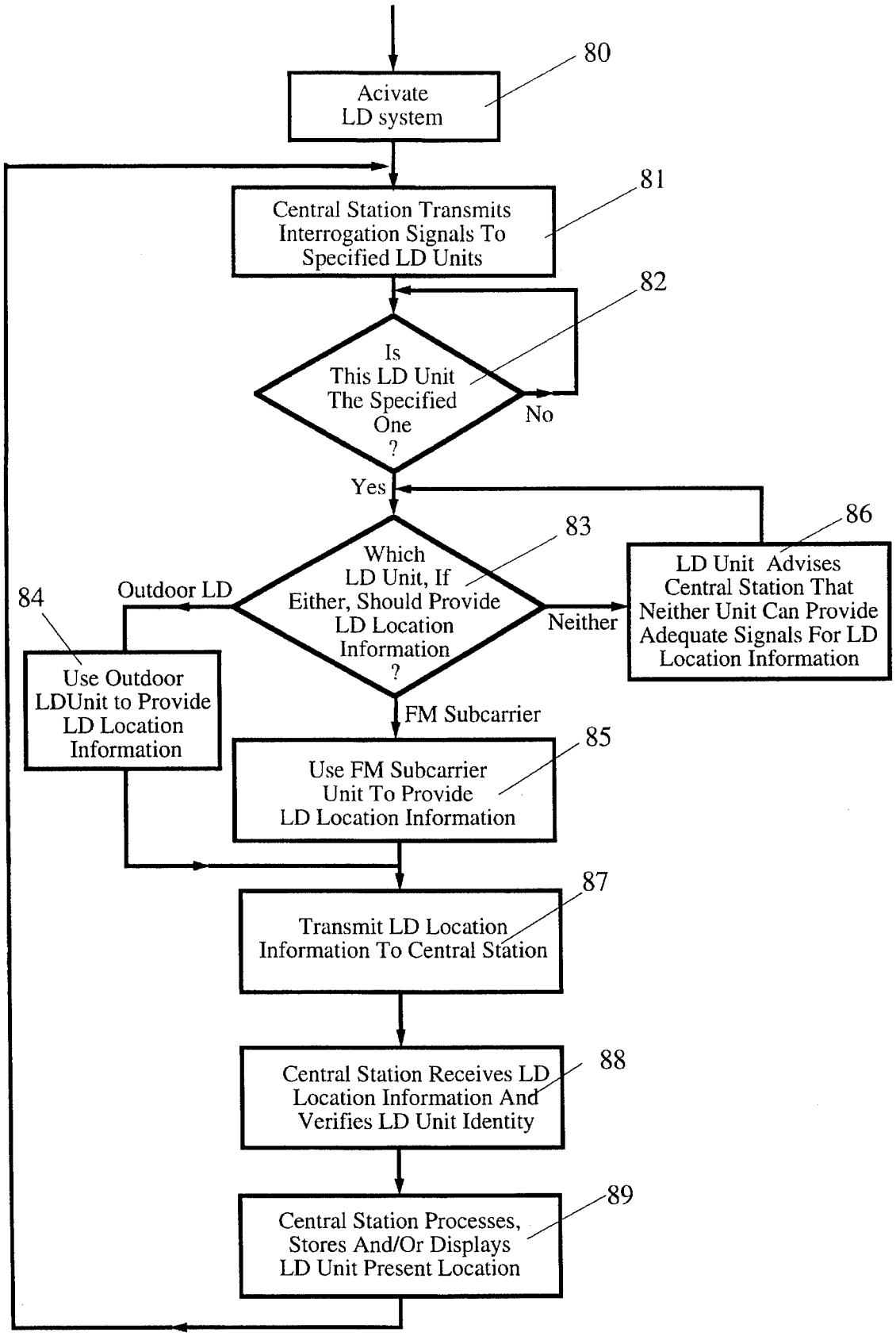
FIG. 7 is a flow chart illustrating a suitable procedure, according to the invention, for determining the present location of a location determination unit, using a combination of FM subcarrier signals and signals generated by an outdoor location determination system.

FIG. 7 is a flow chart of a procedure that can be used to determine the present location of each serviceperson 11, where a combination of FM subcarrier signals and signals provided by an outdoor LD system are used for location determination. The LD system is activated in step 80. The central station interrogates a specified LD unit or LD units by transmitting an interrogation signal with a label, tag or other indicium that identifies that LD unit, in step 81. Each LD unit receives this interrogation signal and determines if the interrogation signal is directed to that LD unit, in step 82. If a given LD unit is not specified by the interrogation signal, that LD unit ignores the interrogation signal and recycles until the LD unit receives another interrogation signal.

If a given LD unit is specified in the interrogation signal, that LD unit automatically determines, in step 83 of FIG. 7, whether the LD information should be provided by the outdoor LD unit, by the FM subcarrier unit, or by neither, based upon the present location of that LD unit and/or an indicium for each FM subcarrier signal and for each, outdoor LD signal that indicates which of the two signals is likely to provide the most accurate location under the circumstances. The indicium for each signal preferably is a measure of the signal robustness, such as signal strength, or the signal quality, such as signal-to-noise ratio. Use of such indicia is discussed in the co-pending patent application entitled "Hybrid Location Determination System", U.S. Ser. No. 08/171,557, assigned to the assignee of this application. In some circumstances, neither the FM subcarrier signals nor the outdoor LD signals may provide acceptable signals for location determination, and the LD unit optionally advises the central station of occurrence of this circumstance, in step 86.

If the LD unit is located outside of and away from all buildings and structures, the LD unit can use the outdoor LD unit to provide LD information on its present location, as in step 84, or can use the FM subcarrier unit for this purpose. If the LD unit is located inside a building or other structure or in another location that is inaccessible to outdoor LD system signals, the FM subcarrier unit provides present location information for the LD unit, in step 85. If neither the FM subcarrier signals nor outdoor LD signals is adequate for location determination, the LD system advises the central station of this, in step 86. In step 87, the LD unit transmits to the central station its LD information, unprocessed, partly processed or fully processed, to the central station, preferably including a first label, tag or other indicium that identifies the responding LD unit and a second label, tag or other indicium indicating which, if any, of the two LD systems has provided the LD information. Optionally, the LD unit can transmit the requested information to the central station in an allocated time slot (of length 10–200 msec) for this response. In step 88, the central station receives the information transmitted by the LD unit, verifies the identity of the responding LD unit, and determines which signal processing route to use, based in part on which LD system has provided the LD information. The central station processes, stores and/or visually or audibly, displays the present location of the specified LD unit in step 89.

Figure 8:
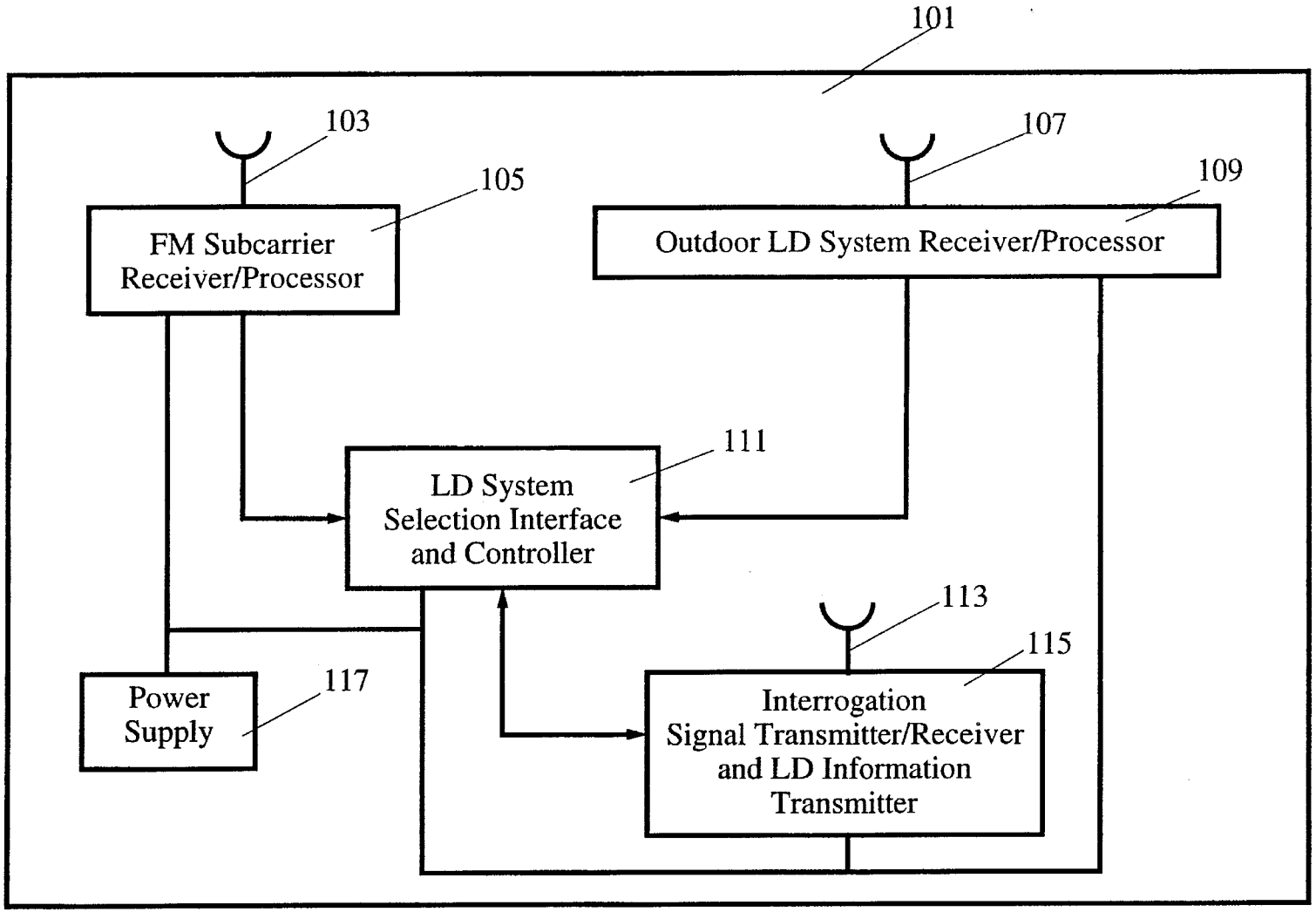
FIG. 8 is a schematic view of a location determination unit that receives and processes FM subcarrier signals and signals from an outdoor location determination system.

FIG. 8 is a schematic view of a portable location determination unit 101 that may be used to practice the invention, where a combination of FM subcarrier signal system and an outdoor LD system are used to determine location of an LD unit in the region R. The LD unit 101 includes an FM subcarrier signal antenna and receiver/processor 103 and 105, an outdoor LD system antenna and receiver/processor 107 arid 109, with each of the receiver/processors being connected to an LD unit selection interface and controller 111. The controller 111 receives location signals or other indicator signals from each of the receiver/processors 105 and 109 and determines whether the FM subcarrier signal system or the outdoor LD system, if any, will be selected to respond to receipt of an interrogation signal requesting location information for the LD unit 101. This selection can be based upon the present location of the LD unit 101 or upon one or more signal conditions associated with the signals received and/or processed by each of the receiver/processors 105 and 109. The output signal (the selected location information signal) of the controller 111 is received by an LD signal transmitter and antenna 113 and 115 and is transmitted to the central station that issued the interrogation signal. The LD signal antenna and transmitter 113 and 115 can also serve as the antenna and receiver, respectively, that receive the interrogation signal transmitted by the central station. A power supply 117 supplies electrical power for at least one of the other components in the LD unit 101. If the LD unit 101 is not required to process any of the LD signals received by either of the antennas 103 and 107, the two receiver/processors 105 and 109 can be replaced by signal receivers in FIG. 8. If only the FM subcarrier signals are used to determine the location of the LD unit 101, the outdoor LD system antenna and receiver/processor 103 and 105 and part or all of the controller 111 can be deleted in the LD unit 101.

Figure 9:
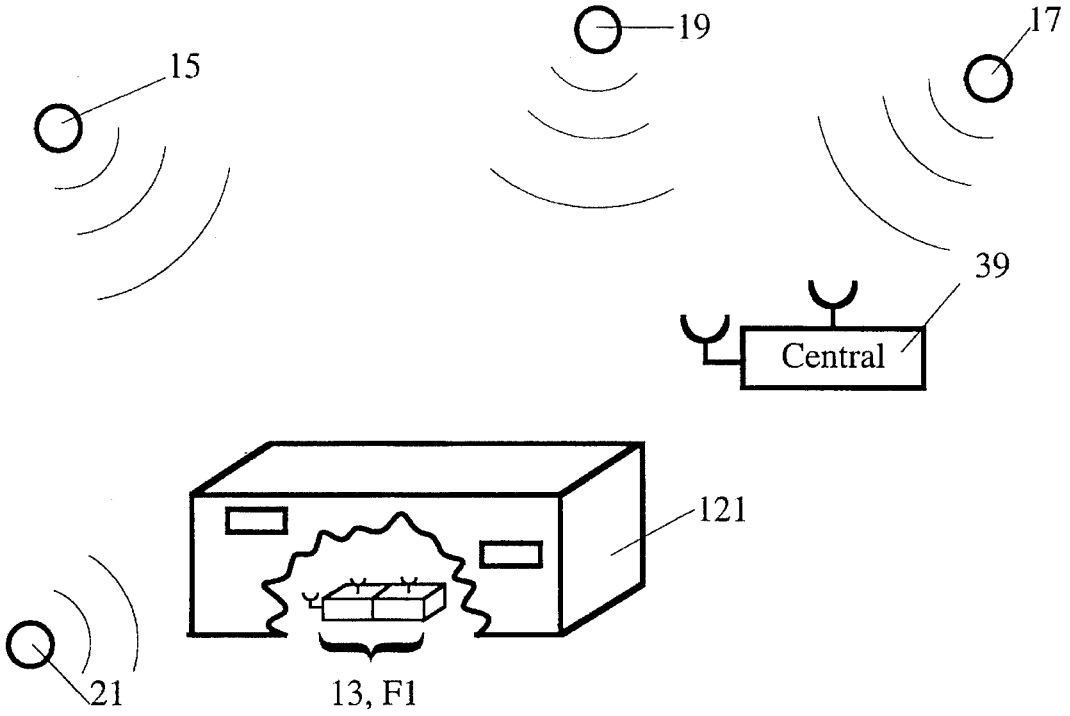
FIGS. 9 and 10 illustrate use of the invention to report the present location of a firefighter inside a building and outside a building, respectively.

When several firefighters are helping to control and quench a fire at a fire site, especially in an urban area, the fire command, communications and control (C3) center often does not know where each firefighter is located from minute to minute. With reference to FIG. 9, if the fire occurs inside one or more buildings 121 and a firefighter F1 moves inside the building to rescue others or to confront the fire directly, it is especially important to know where the firefighter is located within the building—the floor number and the location on that floor (e.g., northeast comer, central stairwell, etc.). The subject invention includes a portable location-determining ("LD") unit 13, carried by the firefighter F1, for receiving certain LD radiowave signals from several sources 15, 17, 19, 21 (optional) of such signals. These LD signals may be transmitted by the LD unit 13, unprocessed, to a,central station 39, located at or near the fire site, to allow determination of the firefighter's present location periodically (e.g., second-by-second). In this mode, only an LD signal transceiver is needed, and signal processing occurs at the central station 39.

Alternatively, these LD signals may be partly or fully processed to partly or fully determine the wearer's present location at the LD unit, and for transmitting this processed information to a nearby central processing station for final determination of the firefighter's present location.

Figure 10:
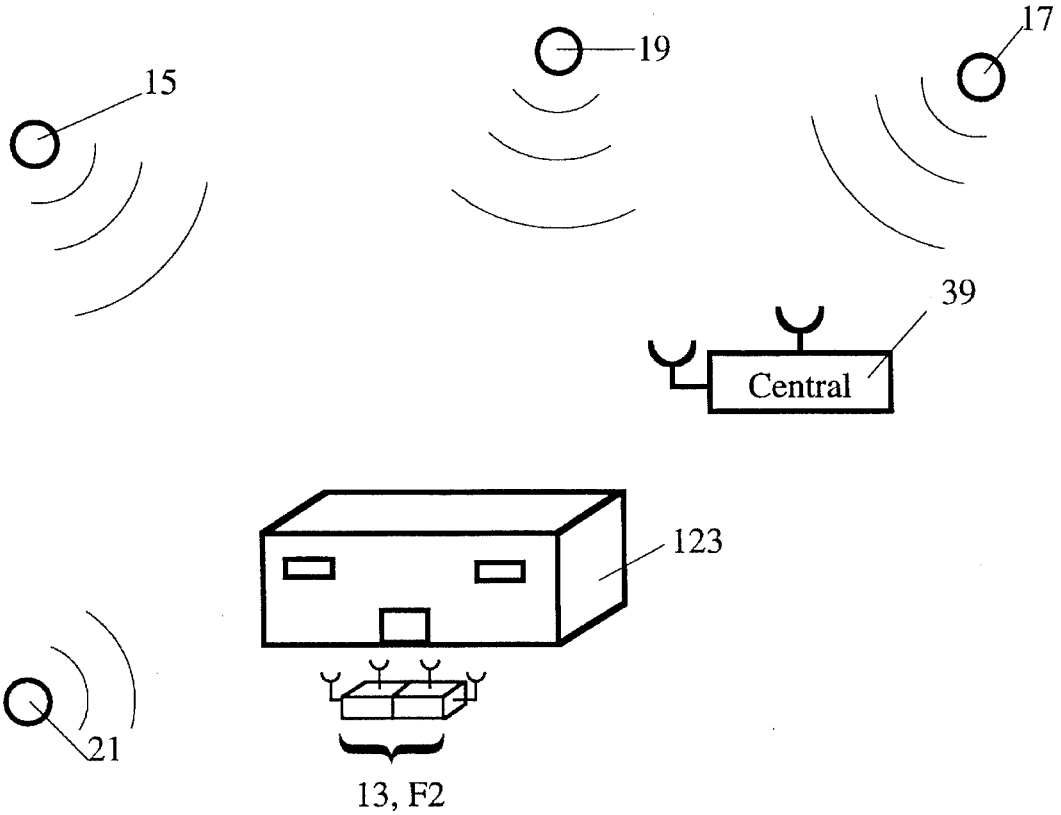

If a firefighter F2 is outdoors or is within any building or other structure 123 that is not electromagnetically isolated, illustrated in FIG. 10, the LD signals may have any frequency, and signals from GPS, GLONASS, Loran, Omega, Decca, Tacan, JITDS Relnav, PLRS, FM subcarrier sources or other radiowave signals may be used. If the firefighter F2 is within an electromagnetically isolating structure that has numerous apertures with diameters large compared to the wavelength of a radiowave, some radiowave signals, such as FM subcarrier signals, may still be received inside the structure without disabling signal attenuation or distortion. Information on the present location of the firefighter F2 is transmitted by the LD unit 13 to a nearby central station 39, as in FIG. 9.

The system described here can monitor and take action based upon the present location of one firefighter or a plurality of firefighters engaged at a fire site. If the location of more than one firefighter is being monitored, each LD unit carded by a firefighter can be allocated a sequence of two or more time slots, where no time slot allocated to one firefighter overlaps any time slot allocated to another firefighter. Each time slot can be divided into two parts: (1) a first part of a time slot, during which the central station 39 transmits an interrogation signal requesting information on the present location of a specified LD unit 13; and (2) a second part of a time slot (possibly non-contiguous with the first part), during which the specified LD unit responds to the interrogation signal. Alternatively, a specified group of LD units when by firefighters could receive and respond to an interrogation signal from the central station in a given time slot in a selected order of response.

An LD unit 13 can also be used to monitor and accumulate the amount of time a given firefighter has spent in each of one or more dangerous sub-regions R1, R2, etc. at the fire site, as illustrated in FIG. 1, using internally provided clock information. Each dangerous subregion can be defined, and the coordinates of each such sub-region and/or its boundary can be entered in the LD unit 13. When the accumulated time a firefighter has spent in such a sub-region exceeds a selected threshold time, the firefighter can be advised or commanded to leave that sub-region and to report to a nearly health monitoring station for immediate assessment of the firefighter's health or physiological indicia.

An LD unit 13 can also be used to monitor how often the present location of a given firefighter changes, as sensed at the central station. If, for example, the present location of the firefighter does not change, or changes by less than a selected threshold amount such as one meter, within a time interval of selected length $\Delta t_{change}$, this may indicate that the firefighter is injured, is trapped or is experiencing difficulty in moving. Alternatively, the LD unit 13 could also monitor and transmit one or more physiological indicia of the firefighter, such as oxygen or chemical content of the air of the air inhaled or exhaled by the firefighter or the firefighter's pulse rate or blood content, and could determine if or when a physiological indicium is within a predetermined danger zone. In this instance, the central station would communicate an alarm signal, perceptible by that firefighter, who can be advised or commanded to leave that sub-region, and/or perceptible by a third party, who can initiate a search-and-rescue operation for that firefighter, using the last reported location of the LD unit attached 19 the firefighter. The time interval length $\Delta t_{change}$ may be in the range from 1–2 seconds up to 30–60 seconds, depending on the circumstances. Preferably, the time interval length $\Delta t_{change}$ includes at least two consecutive interrogation times for the LD unit carried by the-firefighter.

The central station 39 can also communicate an alarm signal if: (i) the LD unit 13 fails to transmit information on its present location for at least K consecutive interrogation times for that LD unit, where K is a selected positive integer; or (ii) the present location of the LD unit, as determined by the central station, is not within or near the designated fire site.

Although the invention has been illustrated by its use to locate firefighters at the scene of a fire or other emergency event, the invention can also be used to monitor and report on the present location of any general service worker or emergency service worker. For example, if one or more workers is engaged in clean-up operations at a hazardous materials "hazmats") spill clean-up site, health and safety considerations may require that the location of each worker, and the amount of time the worker has been exposed to particular hazmats present at some area on the spill site, be tracked and accumulated, in order to comply with OSHA or other workplace standards. One or more sub-regions on the spill site where the hazmat exposure is above a permitted background (chronic) exposure may be defined by the LD unit 13, and the amount of time a worker has spent in each of these sub-regions may be accumulated. When the cumulative exposure of that worker to a given hazmat equals or exceeds a threshold set-by health and/or safety considerations, the worker can be advised or commanded to leave that sub-region and/or to report to a nearby health monitoring station for immediate assessment of the worker's health or physiological indicia. The central station 39 may also communicate an alarm signal if: (i) the present location of the LD unit 13 is not within or near the spill site; (ii) the central station does not receive information transmitted by the LD unit on the LD unit's present location for at least K consecutive interrogation times ($K \geqq 1$); (iii) the location of the LD unit either does not change or changes by less than a selected threshold amount during a time interval of selected length $\Delta t_{change}$; or (iv) one or more of the worker's physiological indicia, as monitored by the LD unit, moves into a predetermined danger zone.

A Satellite Positioning System (SATPS) is a system of satellite signal transmitters, with receivers located on the Earth's surface or adjacent to the Earth's surface, that transmits information from which an observer's present location and/or the time of observation can be determined. Two operational systems, each of which qualifies as an SATPS, are the Global Positioning System and the Global Orbiting Navigational System.

An SATPS antenna receives SATPS signals from a plurality (preferably four or more) of SATPS satellites and passes these signals to an SATPS signal receiver/processor, which (1) identifies the SATPS satellite source for each SATPS signal, (2) determines the time at which each identified SATPS signal arrives at the antenna, and (3) determines the present location of the SATPS antenna from this information and from information on the ephemerides for each identified SATPS satellite. The SATPS signal antenna and signal receiver/processor are part of the user segment of a particular SATPS, the Global Positioning System, as discussed by Tom Logsdon, op. cit.

The Global Positioning System (GPS)is part of a satellite-based navigation system developed by the United States Defense Department under its NAVSTAR satellite program. A fully operational GPS includes up to 24 satellites approximately uniformly dispersed around six circular orbits with four satellites each, the orbits being inclined at an angle of 55° relative to the equator and being separated from each other by multiples of 60° longitude. The orbits have radii of 26,560 kilometers and are approximately circular. The orbits are non-geosynchronous, with 0.5 sidereal day (11,967 hours) orbital time intervals, so that the satellites move with time relative to the Earth below. Theoretically, three or more GPS satellites will be visible from most points on the Earth's surface, and visual access to two or more such satellites can be used to determine an observer's position anywhere on the Earth's surface, 24 hours per day. Each satellite carries a cesium or rubidium atomic clock to provide timing information for the signals transmitted by the satellites. Internal clock correction is provided for each satellite clock.

Each GPS satellite transmits two spread spectrum, L-band carrier signals: an L1 signal having a frequency f1= 1575.42 MHz and an L2 signal having a frequency f2= 1227.6 MHz. These two frequencies are integral multiples f= 1540 f0 and t2= 1200 f0 of a base frequency f0= 1.023 MHz. The L1 signal from each satellite is binary phase shift key (BPSK) modulated by two pseudo-random noise (PRN) codes in phase quadrature, designated as the C/A-code and P-code. The L2 signal from each satellite is BPSK modulated by only the P-code. The nature of these PRN codes is described below.

One motivation for use of two carrier signals L1 and L2 is to allow partial compensation for propagation delay of such a signal through the ionosphere, which delay varies approximately as the inverse square of signal frequency f (delay$\propto f^{-2}$). This phenomenon is discussed by MacDoran in U.S. Pat. No. 4,463,357, which discussion is incorporated by reference herein. When transit time delay through the ionosphere is determined, a phase delay associated with a given carrier signal can be determined.

Use of the PRN codes allows use of a plurality of GPS satellite signals for determining an observer's position and for providing navigation information. A signal transmitted by a particular GPS signal is selected by generating and matching, or correlating, the PRN code for that particular satellite. All PRN codes are known and are generated or stored in GPS satellite signal receivers carried by ground observers. A first PRN code for each GPS satellite, sometimes referred to as a precision code or P-code, is a relatively long, fine-grained code having an associated clock or chip rate of 10 f0= 10.23 MHz. A second PRN code for each GPS satellite, sometimes referred to as a clear/acquisition code or C/A-code, is intended to facilitate rapid satellite signal acquisition and hand-over to the P-code and is a relatively short, coarser-grained code having a clock or chip rate of f0= 1.023 MHz. The C/A-code for any GPS satellite has a length of 1023 chips or time increments before this code repeats. The full P-code has a length of 259 days, with each satellite transmitting a unique portion of the full P-code. The portion of P-code used for a given GPS satellite has a length of precisely one week (7.000 days) before this code portion repeats. Accepted methods for generating the C/A-code and P-code are set forth in the document GPS Interface Control Document ICD-GPS- 200, published by Rockwell International Corporation, Satellite Systems Division, Revision A, Sept. 26, 1984, which is incorporated by reference herein.

The GPS satellite bit stream includes navigational information on the ephemeris of the transmitting GPS satellite and an almanac for all GPS satellites, with parameters providing corrections for ionospheric signal propagation delays suitable for single frequency receivers and for an offset time between satellite clock time and true GPS time. The navigational information is transmitted at a rate of 50 Baud. A useful discussion of the GPS and techniques for obtaining position information from the satellite signals is found in Tom Logsdon, op. cit.

A second configuration for global positioning is the Global Orbiting Navigation Satellite System (GLONASS), placed in orbit by the former Soviet Union and now maintained by the Russian Republic. GLONASS also uses 24 satellites, distributed approximately uniformly in three orbital planes of eight satellites each. Each orbital plane has a nominal inclination of 64.8° relative to the equator, and the three orbital planes are separated from each other by multiples of 120° longitude. The GLONASS circular orbits have smaller radii, about 25,510 kilometers, and a satellite period of revolution of 8/17 of a sidereal day (11.26 hours). A GLONASS satellite and a GPS satellite will thus complete 17 and 16 revolutions, respectively, around the Earth every 8 days. The GLONASS system uses two carrier signals L1 and L2 with frequencies of f1= (1.602+ 9k/16) GHz and f2= (1.246+7k/16) GHz, where k (= 0, 1, 2, . . . , 23) is the channel or satellite number. These frequencies lie in two bands at 1.597–1.617 GHz (L1) and 1,240–1,260 GHz (L2). The L1 code is modulated by a C/A-code (chip rate= 0.511 MHz) and by a P-code (chip rate= 5.11 MHz). The L2 code is presently modulated only by the P-code. The GLONASS satellites also transmit navigational data at at rate of 50 Baud. Because the channel frequencies are distinguishable from each other, the P-code is the same, and the C/A-code is the same, for each satellite. The methods for receiving and analyzing the GLONASS signals are similar to the methods used for the GPS signals.

Reference to a Satellite Positioning System or SATPS herein refers to a Global Positioning System, to a Global Orbiting Navigation System, and to any other compatible satellite-based system that provides information by which an observer's position and the time of observation can be determined, all of which meet the requirements of the present invention.

A Satellite Positioning System (SATPS), such as the Global Positioning System (GPS) or the Global Orbiting Navigation Satellite System (GLONASS), uses transmission of coded radio signals, with the structure described above, from a plurality of Earth-orbiting satellites. A single passive receiver of such signals is capable of determining receiver absolute position in an Earth-centered, Earth-fixed coordinate reference system utilized by the SATPS.

A configuration of two or more receivers can be used to accurately determine the relative positions between the receivers or stations. This method, known as differential positioning, is far more accurate than absolute positioning, provided that the distances between these stations are substantially less than the distances from these stations to the satellites, which is the usual case. Differential positioning can be used for survey or construction work in the field, providing location coordinates and distances that are accurate to within a few centimeters.

In differential position determination, many of the errors in the SATPS that compromise the accuracy of absolute position determination are similar in magnitude for stations that are physically close. The effect of these errors on the accuracy of differential position determination is therefore substantially reduced by a process of partial error cancellation.

We claim:

1. A method for monitoring the location of a general service worker or emergency service worker at a designated site, the method comprising the steps of:

selecting a designated site where the general or emergency service worker will perform services;

positioning a location-determining (LD) unit on the body or the garments of the worker, the LD unit including an antenna and receiver/processor for receiving a sequence of radiowave signals from three or more spaced apart electromagnetic signal transmitters whose transmitter locations are known with high accuracy, where these electromagnetic signals contain information that allows the present location of the LD unit to be determined, where the carrier frequencies of at least three of the electromagnetic signals are chosen so that these signals can be received, within a building-like structure having at least one aperture as well as outside such a structure, without substantial signal attenuation or distortion;

providing attachment means for attaching the LD unit to at least one of the worker's body and the worker's garments so that the LD unit does not interfere with performance of the worker's services;

providing a central station, having a signal receiver and processor, a signal transmitter, and an electronically sensible map of a selected portion of the Earth's surface that includes the coordinates of the designated site;

providing the LD unit with a sequence of two or more selected, spaced apart interrogation times;

causing the LD unit receiver/processor to determine the present location of the LD unit and to transmit information on the LD unit's present location to the central station receiver at the sequence of selected interrogation times;

causing at least one of the central station and the LD unit to determine the coordinates of the present location of the LD unit and to compare these coordinates with the coordinates of the designated site; and causing the central station transmitter to communicate an alarm signal, which is perceptible by at least one person other than the worker at the designated site, if/at least one] any of the following conditions is present: (i) the present location of the LD unit is not within the designated site for at least one of the interrogation times; (ii) the central station does not receive transmitted information on the present location of the LD unit for at least K consecutive interrogation times, where K is a selected integer $\geqq 1$; (iii) the present location of the LD unit, as sensed by the central station, changes by less than a selected threshold amount during a time interval of selected time interval length $\Delta t_{change}$ that includes at least two consecutive interrogation times for the LD unit; (iv) the LD unit receives an interrogation signal requesting information on the present location of said LD unit; and (v) the accumulated time, during which the present location of the LD unit is within a selected sub-region of the designated site, exceeds a selected time $\Delta t_{exposure}$.

2. The method of claim 1 further comprising the steps of:

choosing as said electromagnetic signal transmitters three or more FM subcarrier signal transmitters that each broadcasts an FM subcarrier signal having a preselected frequency;

providing said LD unit with information on a signal phase of each FM subcarrier signal relative to the phase of a selected one of the FM subcarrier signals; and providing each of these subcarrier signals with a subcarrier source indicium contained therein that identifies which transmitter has transmitted a particular FM subcarrier signal.

3. The method of claim 2, wherein said step of causing said central station to determine said present location of said LD unit comprises the steps of:

determining an initial location of said LD unit with reference to said designated site;

determining initial relative phases of said FM subcarrier signals as these signals arrive at said LD unit at times near the interrogation times; and subsequently determining changes in the relative phases of said subcarrier signals with reference to the initial relative phases, and determining the change in present location coordinates of said LD unit according to the changes in the relative phases.

4. The method of claim 2, wherein said step of causing said central station to determine said present location of said LD unit comprises the steps of:

providing a subcarrier signal receiver at a location that is known to said LD unit, and determining the relative phases of said three FM subcarrier signals;

providing this information on the relative phases of said subcarrier signals to said LD unit at one or more selected times; and subsequently determining changes in the relative phases of said subcarrier signals with reference to an initial relative phase of each of said subcarrier signals, and determining the change in present location coordinates of the LD unit according to the changes in the relative phases.

5. The method of claim 2, wherein said step of providing said LD unit with information on the phase of each of said FM subcarrier signals comprises the steps of:

providing an FM signal monitor with known location that receives each of said FM subcarrier signals and determines the phase of each of said FM subcarrier signals relative to said selected FM subcarrier signal;

positioning the FM signal monitor at a location that is spaced apart from a plane defined by the locations of said three or more FM subcarrier signal transmitters; and transmitting information on the relative phase of each of said FM subcarrier signals to said LD unit.

6. The method of claim 1, further comprising the steps of:

choosing as said electromagnetic signal transmitters a combination of (i) three or more FM subcarrier signal transmitters that each transmits an FM subcarrier signal having a subcarrier source indicium that identifies that transmitter and (ii) three or more outdoor LD signal transmitters that each transmits an outdoor LD signal having an LD source indicium that identifies that transmitter;

providing said LD unit with information on the phase of each FM subcarrier signal relative to the phase of a selected one of the FM subcarrier signals;

using the outdoor LD signals to determine the present location of the LD unit wherever the outdoor LD signals can be received without substantial attenuation or distortion; and using the FM subcarrier signals to determine the present location of the LD unit wherever the outdoor LD signals cannot be received without substantial attenuation or distortion.

7. The method of claim 6, wherein said step of causing said central station to determine said present location of Said LD unit comprises the steps of:

determining at a selected phase determination time said present location of said LD unit on said designated site;

determining initial relative phases of said FM subcarrier signals as these signals arrive at said LD unit; and subsequently determining changes in the relative phases of said subcarrier signals with reference to the initial relative phases, and determining the change in said present location of said LD unit according to the changes in the relative phases.

8. The method of claim 6, wherein said step of providing relative phase information on said FM subcarrier signals comprises the steps of:

providing an FM subcarrier signal receiver at a location that is known to said LD unit, and determining the relative phases of each FM subcarrier signal as this signal is transmitted;

providing this relative phase information to said LD unit at one or more selected times; and subsequently determining changes in the relative phases of said FM subcarrier signals with reference to the initial relative phases, for at least one time subsequent to the time the relative phase information is provided to said LD unit.

9. The method of claim 6, further comprising the step of choosing said outdoor LD signals from a class consisting of GPS signals, GLONASS signals, Loran signals, Omega signals, Tacan signals, Decca signals, JTIDS Relnav signals and PLRS signals.

10. The method of claim 1, further comprising the step of causing said LD unit to monitor at least one physiological indicium of said emergency service worker, and choosing said specified group of conditions to include the condition that this physiological indicium is within a predetermined danger zone for said worker.

11. The method of claim 1, further comprising the steps of:

choosing as said electromagnetic signal transmitters a combination of four or more FM subcarrier signal transmitters that each transmits an FM subcarrier signal having a subcarrier source indicium that identifies that transmitter, where one of these FM transmitters is located far from a plane passing through three other FM transmitters;

providing said LD unit with information on the phase of each FM subcarrier signal relative to the phase of a selected one of the FM subcarrier signals; and using the FM subcarrier signals to determine said present location of said LD unit.

12. Apparatus for determining the present location, at a designated site, of a mobile user that carries the apparatus inside or outside buildings and structures, the apparatus comprising:

FM subcarrier means, carried by the user, for determination of the present location of the user, the FM means comprising:

an FM signal antenna and associated FM signal receiver/processor to receive FM subcarrier signals transmitted from at least three spaced apart FM subcarrier signal sources, with each of these FM subcarrier signals having a subcarrier source indicium that identifies the source for that FM subcarrier signal, to receive relative phase information on the FM signals received by the FM signal antenna, to determine the present location of the FM antenna from knowledge of the relative phases of signals received from the FM subcarrier sources, to determine an FM signal indicium that is a measure of at least one of the determined present location of the FM antenna, signal robustness and signal quality of these FM subcarrier signals, and to issue information on the FM antenna present location and the FM signal indicium as output signals; and phase information means for receiving information on the relative phases of signals transmitted from the FM subcarrier signal sources and for passing this information to the FM receiver/processor;

outdoor location determination (LD) means, carried by the user, for determination of the present location of the user, the outdoor LD means comprising:

an outdoor LD signal antenna and associated outdoor LD signal receiver/processor to receive outdoor LD signals transmitted from at least three spaced apart outdoor LD signal sources, with each of these outdoor LD signals having an LD source indicium that identifies the source of that outdoor LD signal, to determine the location of the outdoor LD antenna from analysis of these LD signals, to determine an outdoor LD signal indicium that is a measure of at least one of the determined present location of the outdoor LD antenna, signal robustness and signal quality of these outdoor LD signals, and to issue the outdoor LD antenna present location information and the outdoor LD signal indicium as output signals;

controller means, for receiving the FM receiver/processor output signals and the outdoor LD receiver/processor output signals, for comparing the FM signal indicium with a selected FM signal indicium threshold, for comparing the outdoor LD signal indicium with a selected outdoor LD signal indicium threshold, for selecting from these comparisons at most one of the FM antenna present location information and the outdoor LD antenna present location information as user present location information, and for issuing the selected user present location information as a controller means output signal; and transceiver means, connected to the controller means, for receiving the controller means output signal, for receiving at least two location interrogation signals, spaced apart in time, that command the transceiver means to transmit information on the present location of at least one of the FM signal antenna and the outdoor LD signal antenna, and for transmitting the controller means output signal to a selected receiver spaced apart from the user when at least one of a specified group of conditions is present.

13. The apparatus of claim 12, wherein said specified group of conditions includes at least one of the following conditions: (i) said present location of said LD unit is not within the designated site for at least one of the interrogation times; or (ii) said central station does not receive transmitted information on said present location of said LD unit for at least K consecutive interrogation times, where K is a selected integer >_ 1; (iii) said present location of said LD unit, as sensed by the central station, changes by less than a selected threshold amount during a time interval of selected time interval length $\Delta t_{change}$ that includes at least two consecutive interrogation times for said LD unit; and (iv) said LD unit receives an interrogation signal requesting information on said present location of said LD unit; and (v) the accumulated time, during which said present location of said LD unit is within a selected sub-region of the designated site, exceeds a selected time $\Delta t_{exposure}$.

14. The apparatus of claim 12, further comprising physiological monitoring means for monitoring at least one physiological indicium of said mobile user, where said specified group of conditions includes the condition that this physiological indicium is within a predetermined danger zone for said worker.

15. The apparatus of claim 12, wherein said transceiver means generates an alarm signal, which is perceptible by at least one person other than said mobile user, if at least one of the following conditions is present: (i) the present location of said subcarrier means or said outdoor LD means is not within the designated site for at least one of the interrogation times; (ii) the central station does not receive transmitted information on the present location of at least one of said subcarrier means or said outdoor LD means for at least K consecutive interrogation times, where K is a selected integer $\geqq 1$; (iii) the present location of said subcarrier means or said outdoor LD means, as sensed by the central station, changes by less than a selected threshold amount during a time interval of selected time interval length $\Delta t_{change}$ that includes at least two consecutive interrogation times for the LD unit; (iv) said subcarrier means or said outdoor LD means receives an interrogation signal requesting information on the present location of said LD unit; and. (v) the accumulated time, during which the present location of said subcarrier means or said outdoor LD means is within a selected sub-region of the designated site, exceeds a selected time $\Delta t_{exposure}$.

16. A method for monitoring the location of a general service worker or emergency service worker at a designated site, the method comprising the steps of:

selecting a designated site where the general or emergency service worker will perform services;

positioning a first location-determining (LD) unit on the body or the garments of the worker, the first LD unit including an antenna and receiver/processor for receiving a sequence of radiowave signals from three or more electromagnetic signal transmitters whose transmitter locations are spaced apart from the designated site and are known with high accuracy, where these electromagnetic signals contain information that allows the present location of the first LD unit to be determined;

positioning a second LD unit on the body or the garments of the worker, the second LD unit operating independently of the first LD unit and including an antenna and receiver/processor for receiving a sequence of radiowave signals from three or more electromagnetic signal transmitters whose transmitter locations are spaced apart from the designated site and are known with high accuracy, where these electromagnetic signals contain information that allows the present location of the second LD unit to be determined, where the carrier frequencies for the electromagnetic signals used by the second LD unit are chosen so that these signals can be received, within a building-like structure having at least one aperture as well as outside such a structure, without substantial signal attenuation or distortion;

providing attachment .means for attaching the first LD unit and the second LD unit to at least one of the worker's body and the worker's garments so that the first LD unit and the second LD unit do not interfere with performance of the worker's services;

providing a central station, having a signal receiver and processor, a signal transmitter, and an electronically sensible map of a selected portion of the Earth's surface that includes the coordinates of the designated site;

providing the first LD unit and the second LD unit with a sequence of two or more selected, spaced apart interrogation times;

causing the first LD unit receiver/processor and the second LD unit receiver/processor to determine, at each interrogation time, the present location of the first LD unit and the second LD unit, respectively;

transmitting information on the present location of at least one of the first LD unit and the second LD unit to the central station receiver;

causing at least one of the central station processor, the first LD unit and the second LD unit to determine the coordinates of the present location of at least one of the first LD unit and the second LD unit from the information received and to compare these coordinates with the coordinates of the designated site; and causing the central station transmitter to communicate an alarm signal, which is perceptible by at least one person other than the worker at the designated site, if one or more of a specified group of conditions is present, based on this comparison.

17. The method of claim 16, wherein said step of positioning said second LD unit on said body or garments of said worker comprises the steps of:

choosing as said electromagnetic signal transmitters three or more FM subcarrier signal transmitters that each broadcasts an FM subcarrier signal having a preselected frequency;

providing said second LD unit with information on a signal phase of each FM subcarrier signal relative to the phase of a selected one of the FM subcarrier signals; and providing each of these subcarrier signals with a subcarrier source indicium contained therein that identifies which transmitter has transmitted a particular FM subcarrier signal.

18. The method of claim 17, further comprising the steps of:

providing as said first LD unit an outdoor LD unit that includes three or more outdoor LD signal transmitters that each transmits an outdoor LD signal having an LD source indicium that identifies that transmitter;

using the outdoor LD signals to determine the present location of the LD unit wherever the outdoor LD signals can be received without substantial attenuation or distortion; and using said second LD unit to determine the present location of the LD unit wherever the outdoor LD signals cannot be received without substantial attenuation or distortion.

19. The method of claim 18, further comprising the step of choosing said outdoor LD signals from a class consisting of GPS signals, GLONASS signals, Loran signals, Omega signals, Tacan signals, Decca signals, JTIDS Relnav signals and PLRS signals.

20. The method of claim 16, further comprising the step of choosing said specified group of conditions to include at least one of the following conditions: (i) said present location of said first LD unit or of said second LD unit is not within the designated site for at least one of said interrogation times; or (ii) said central station does not receive transmitted information on said present location of said first LD unit or of said second LD unit for at least K consecutive interrogation times, where K is a selected integer $\leqq 1$; (iii) said present location of said first LD unit or of said second LD unit, as sensed by the central station, changes by less than a selected threshold amount during a time interval of selected time interval length $\Delta t_{change}$ that includes at least two consecutive interrogation times for said first LD unit or said second LD unit; (iv) said first LD unit or said second LD unit receives an interrogation signal requesting information on said present location of said first LD unit or said second LD unit; and (v) the accumulated time, during which said present location of said first LD unit or of said second LD unit is within a selected subregion of the designated site, exceeds a selected time $\Delta t_{exposure}$.

21. The method of claim 16, further comprising the step of choosing said outdoor LD signals from a class consisting of GPS signals, GLONASS signals, Loran signals, Omega signals, Tacan signals, Decca signals, JTIDS Relnav signals and PLRS signals.

22. The method of claim 16, further comprising the step of choosing said specified group of conditions to include at least one of the following conditions: (i) the present location of the LD unit is not within the designated site for at least one of the interrogation times; (ii) the central station does not receive transmitted information on the present location of the LD unit for at least K consecutive interrogation times, where K is a selected integer $\geqq 1$; (iii) the present location of the LD unit, as sensed by the central station, changes by less than a selected threshold amount during a time interval of selected time interval length $\Delta t_{change}$ that includes at least two consecutive interrogation times for the LD unit; (iv) the LD unit receives an interrogation signal requesting information on the present location of said LD unit; and (v) the accumulated time, during which the present location of the LD unit is within a selected subregion of the designated site, exceeds a selected time $\Delta t_{exposure}$.

* * * * *